United States Patent [19]

Humphrey

[11] 4,158,947

[45] Jun. 26, 1979

[54] YACHT TIMER

[76] Inventor: Donald R. Humphrey, 6 Carriage La., S. Hamilton, Mass. 01982

[21] Appl. No.: 788,274

[22] Filed: Apr. 14, 1977

[51] Int. Cl.[2] ..... G04B 19/06

[52] U.S. Cl. ..... 58/127 R; 58/128; 58/91; 58/74

[58] Field of Search ..... 220/82 R, 82 A; 58/91, 58/42.5, 127 R, 127 A, 127 B, 128, 126 R, 126 A, 125 B, 90, 74–79; 73/431; 116/129 F, 129 E, 129 C, 129 R, 129 N, DIG. 3; 200/38 FA, 308

[56] References Cited

U.S. PATENT DOCUMENTS

| | | | |
|---|---|---|---|
| 843,887 | 2/1907 | Gerson | 58/74 |
| 1,796,652 | 3/1931 | Hawley | 58/91 |
| 2,939,420 | 6/1960 | Hewitt | 58/126 R X |
| 3,283,496 | 11/1966 | Hohenthaner | 58/127 R X |
| 3,505,808 | 4/1970 | Eschle | 58/126 B |
| 3,665,701 | 5/1972 | Burdet | 58/127 R X |
| 3,785,142 | 1/1974 | Soguel | 58/90 R |

FOREIGN PATENT DOCUMENTS

| | | | |
|---|---|---|---|
| 2775 of | 1913 | United Kingdom | 58/127 R |

*Primary Examiner*—Ulysses Weldon
*Attorney, Agent, or Firm*—Herbert L. Gatewood

[57] ABSTRACT

There is provided in accordance with the invention a yacht timer and a means for converting a conventional sweep second watch or clock into a yacht timer, either of which will be found useful in both fun and highly competitive sailboat racing.

7 Claims, 8 Drawing Figures

YACHT TIMER

BACKGROUND OF THE INVENTION (1) Field of the Invention

This invention relates to a yacht timer and a means for converting a conventional sweep second watch or clock, particularly a wristwatch, into a yacht timer for use in sailboat racing.

(2) Description of the Prior Art

One of the many wonderful lures of sailboat racing is that there is a race to suit the taste of nearly every sailor. There are races for male and female, young and old, summer and winter. Regardless of the many different types of hulls, and the fact that boats vary in size and style, there are primarily two major classifications of racing in which a group of sailboats race against each other as individuals, i.e., not as a team, namely one design or class-boat racing and handicap racing.

One design is in general, a race between boats of the same class, i.e., boats which are nearly identical, racing on even terms. In this boat-for-boat race, the boat with the fastest elapsed time, from the start of the race to the finish, or the first boat over the finish line, wins the race.

Although one design races commonly involve individuals racing against one another, another manner of racing one design boats is as a team. Thus, a race might, for example, involve two four boat teams. The winning team could be scored either as the first to win two races out of a possible three or the like, or some manner of team point scoring.

Handicap racing differs from class-boat racing in that it is a race handicapped by some type of time-allowance system to make all boats in the race as evenly matched as possible. With the resulting handicap rating, sloops, cutters, yawls, ketches, and schooners are able to compete evenly with each other regardless of size. The winning boat is the one with the best corrected time, or the best time for sailing the course, after handicap corrections have been made.

A relatively new addition to the offshore racing scene, and which is a species of handicap racing, is performance handicap racing fleet (P.H.R.F.). This system bases its ratings on the actual performance of a particular type of boat, not on a rating system based on projected speed potential of a particular design. With such a system, older design boats are made more competitive, and more fairly handicap racing entries.

Class-boat racing, of these two major classes of boat racing is believed by far the most popular manner of boat racing in the United States. However, races of both types take place offshore on almost every sound and bay and inland on numerous lakes, and rivers, on the North American continent.

In its barest essentials, a course for a yacht race, comprises a start, a place to go, and a finish. The start is a line to be crossed. The place to go is sometimes, as in some ocean races, nothing more than a statement about the finish in which case the only marks may be the marks of the starting and the finishing lines. In most cases, however, there are from one to half a dozen or more marks which yachts are required to round, thereby establishing a minimum distance which each yacht must sail. And finally, the finish, like the start, is a line to be crossed.

No part of a yacht race more consistently determines which yacht will have a chance to win it, and which will not, than the start. Getting a good start will generally assure a position at the front of the fleet at the weather mark, barring poor speed or bad judgement, or wind shifts. A good start is a necessary part of winning, and is half the race in relatively small, one-design boats. When the boats are very nearly equal and the skippers all known how to sail, there isn't much room for very much difference in how fast the boats get around the race course. The skipper who starts ahead has every chance at staying ahead.

It is, of course, basic that a racing skipper must known the starting signals that will be used for a particular race. One system customarily used to start a race is that at precisely ten minutes before the start a warning signal is given from the race committee boat. This signal is given audibly with a gun or whistle, and at the same time it is given visibly with the hoisting of a flag or shape. Exactly four and one-half minutes later, the warning shape which is usually white, is hauled down and 30 seconds later, another signal, the preparatory signal, is given audibly and visibly with a gun or whistle, and the hoisting of another flag or shape, usually colored blue. Four and one-half minutes later, the preparatory shape is hauled down; and thirty seconds after this, the start signal is given audibly and visibly with a gun or whistle, and the hoisting of the starting shape or flag, usually colored red. Although these various signals may be done both audibly and visibly, actually the visual signal gives the exact, and official, time of the start.

The object or goal in sail boat racing as in any race is, of course, to win and one important objective in reaching that goal is to reach the starting line just as the starting signal is made, and at the right place on the line, depending on the wind and course, with the boat sailing at top speed. This is an ideal situation, of course, that few racing shippers achieve consistently, at least until after considerable racing experience.

One of the most important things to remember about the start of a race is that the initial signal, i.e., the warning signal, is given a fairly long time, e.g. ten minutes, before the actual starting time of the race. Accordingly, a skipper must develop some skill and sense of timing in sailing to and from the starting line in preparation for the start of the race. When the starting signal is given, the race can almost be over for the skipper who is in the wrong place, i.e., he is sailing away from the starting line or is just too far distance from it to get a good start. To insure against being at the wrong place at the time of start, racing skippers, especially the very serious ones, or where the race involved is an important one, use a yachting timer, i.e., a specially constructed wrist or pocket watch having a special dial face, and which operates somewhat in the manner of a stop watch. There are also digital countdown timers available for bulkhead mounting, in the case of larger boats, if desired. These various yacht timers provide various countdowns, e.g., ten and fifteen minute displays, or counts repeatedly from 5'00" to 0'00".

Some racing skippers do not have yacht timers as above described and, in order to have at least some means of timing the start of the race, use a conventional stop watch. This, as will be appreciated does not provide the racing skipper with "time-to-go" and, as a result, often leads to confusion.

SUMMARY OF THE INVENTION

There is provided in accordance with the invention a rather simple, useful, and economical yacht timing means which provides countdown or time-to-go to the start of the race, as do yacht timers now available. This is accomplished in accordance with one aspect of the invention by detachably combining a conversion means in accordance with the invention with a parent sweep second watch or clock, and which in the case of a watch can be either a wrist or pocket watch, as desired. However, the invention will be hereinafter more particularly disclosed with respect to a parent sweep second wrist watch.

Quite advantageously, the conversion means of the invention provides count down time for sail racing starts in minutes and seconds by making use of the face and the minute and sweep second movement of the parent wrist watch. As the conversion device makes use of one's existing wrist watch, the invention not only provides an economical yachting or count down timer but one with which the racing skipper using it is already somewhat familiar.

In its most basic aspects, the conversion means comprises two clear plastic superposed rotatable, preferably ratcheted, dials, one being marked with seconds for rotation in one direction and the other being marked with minutes for rotation in the other direction, mounted so that the dials can be temporarily, but fixedly, clamped onto the face of a sweep second wrist watch. Contrary to the conventional wrist watch yachting timer, which is set for countdown by stopwatch action, the yachting timer according to the invention is set by turning with one's fingers the two ratcheted dials, as will be more fully explained hereinafter.

The conversion means of the invention when temporarily combined with, or clamped onto, a parent wrist watch can be used by the racing skipper as the only yacht timer for a particular race, or as an additional or substitute yacht timer, as desired.

In accordance with further aspects of the invention, as earlier alluded to, there is provided a yachting timer which comprises in permanent combination a conventional sweep second watch, either a pocket or wrist watch, and the conversion means of the invention. As will be appreciated, a clock, wind up or electric can be provided in combination with the conversion means, rather than a watch, if desired.

BRIEF DESCRIPTION OF THE DRAWING

The invention will be better understood by referring to the drawing in which like numerals refer to like parts in the various views, and in which.

DETAILED DESCRIPTION OF THE INVENTION AND THE PREFERRED EMBODIMENT

Figure 1:
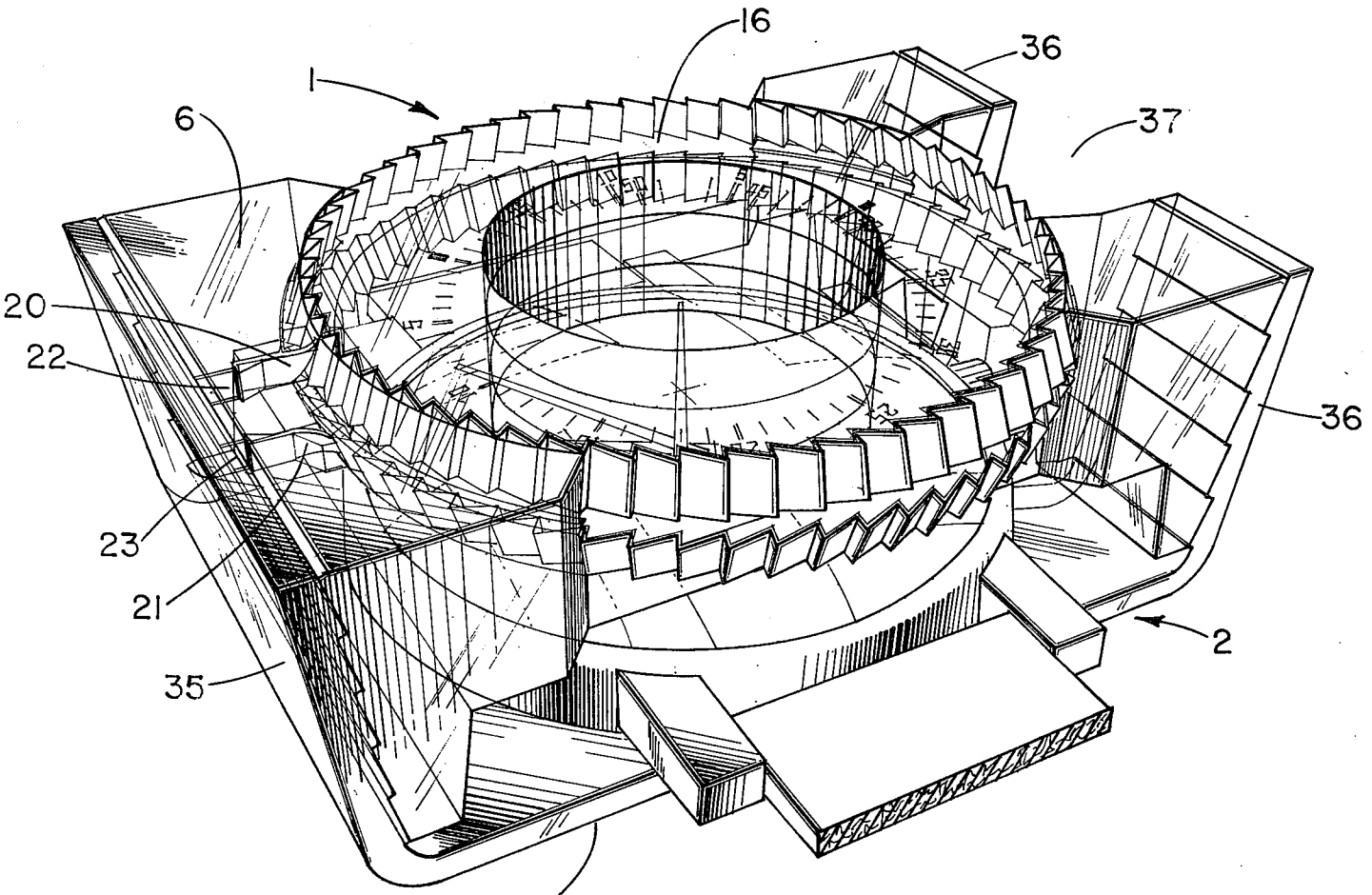
FIG. 1 is a view in perspective of conversion means in accordance with the invention clamped in detachable combination with a parent conventional sweep second wrist watch, with the wrist band cut away, whereby a relatively simple and economical yacht, or countdown, timer is provided.

Turning now to the drawing, there is shown in FIG. 1 thereof in combination a means 1 for conversion of a parent sweep second wrist watch 2 into a yacht, or countdown timer. Conversion means 1 comprises a face piece assembly 3 which is detachably connected to a back assembly 4 by means hereinafter described. Facepiece assembly 3 comprises a base member or housing 5 of somewhat inverted solid trapezoidal configuration, defined by a top surface 6, a bottom surface 7 parallel to the top surface, parallel side members 8,9, and end members 10,11 which depend inwardly from top surface 6 toward one another and connect surfaces 6,7, together.

Figure 3:
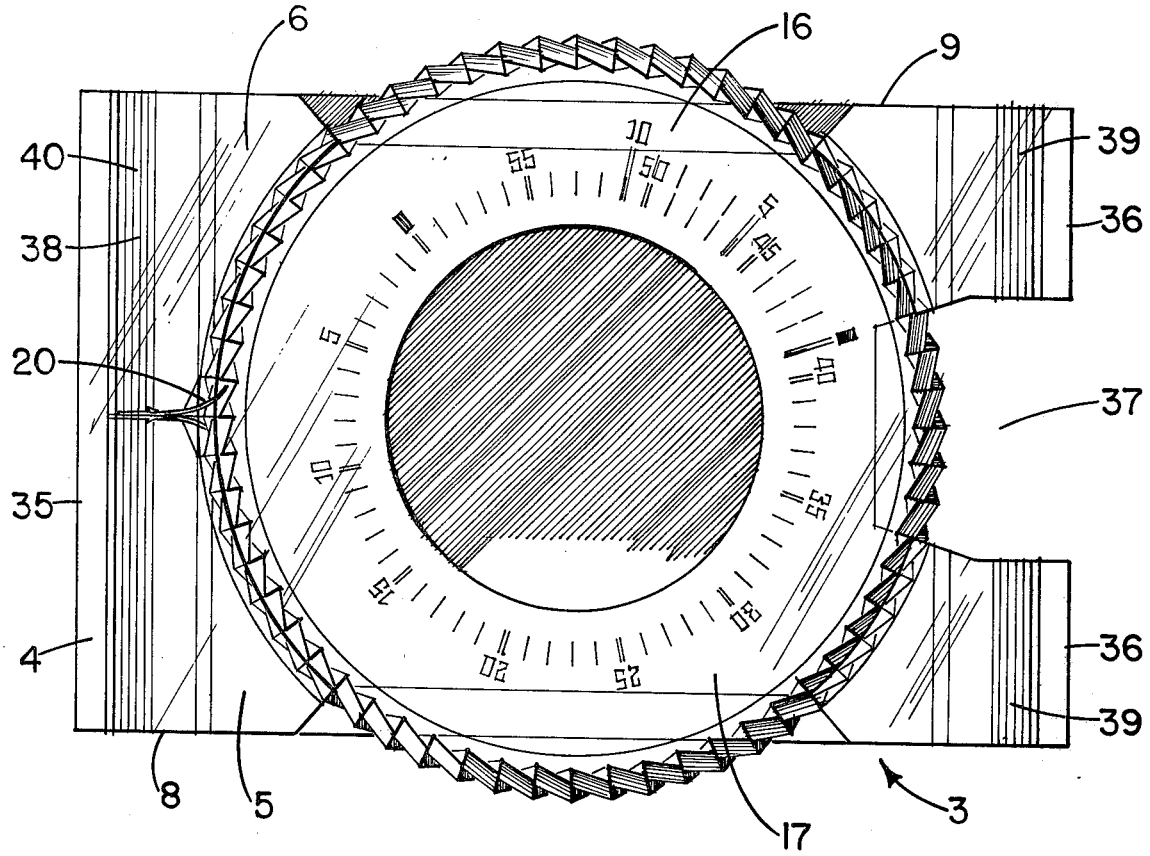
FIG. 3 is a plan view of the conversion means only shown in FIGS. 1 and 2.
Figure 4:
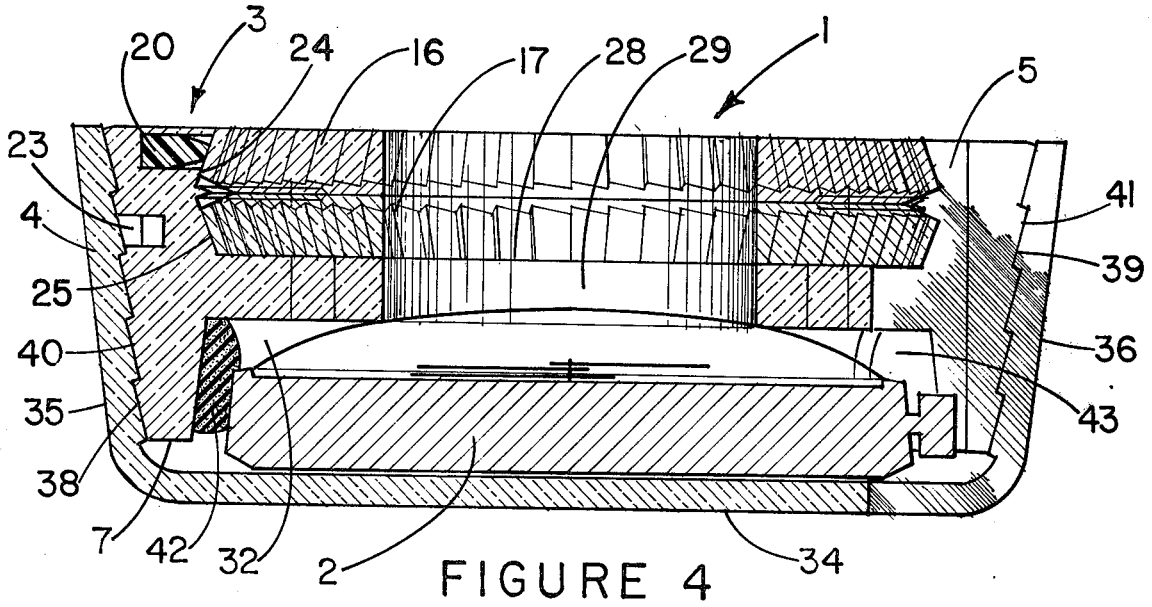
FIG. 4 is a view in cross-section showing the conversion means of the invention and a watch in combination.
Figure 6:
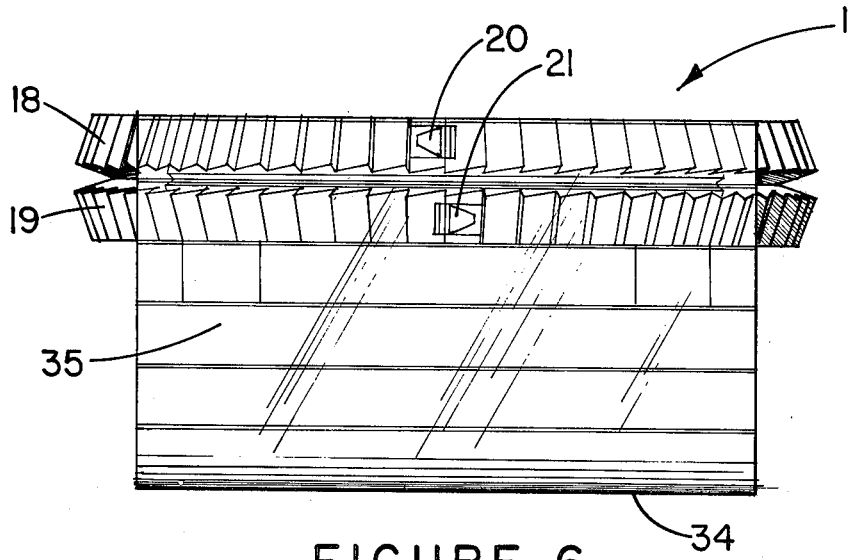
FIG. 6 is an end view of the conversion means taken looking at the left end as shown in FIG. 5.

In the top surface 6 of housing 5 there is provided a recess 12 in the side walls of which are located outlets 13,14 and 15. Located in recess 12 are a minute dial 16 and a seconds dial 17, these dials being recessed into the top surface 6 of housing 5 in such a manner, as more clearly shown in FIG. 4 of the drawing, as to provide substantially a continuous planar top surface of generally rectangular configuration. Dials 16,17, as is shown in FIG. 3, are of such a diameter as to extend laterally beyond housing 5 on each side thereof in oppositely located recess outlets 13,15. Thus, the dials can be turned by hand as and when desired. It will be recognized, however, that the top surface 6 of the housing 5 need not be of rectangular configuration or need dials 16, 17 be recessed so as to be in the same plane as surface 6.

Dials 16,17, as indicated, are of annular configuration and are provided around their respective outer beveled circumferential surfaces with ratchet teeth 18,19. Ratchet teeth 18, as clearly shown in FIG. 1, are provided in opposite direction to ratchet teeth 19 so that dials 16, 17 can be rotated by finger movement, as later discribed, in opposite directions only. Ratchets 20,21 are provided in housing 5 for engagement with ratchet teeth 18,19, respectively, so as to prevent movement of the dials 16,17 except in one direction.

Figure 8:
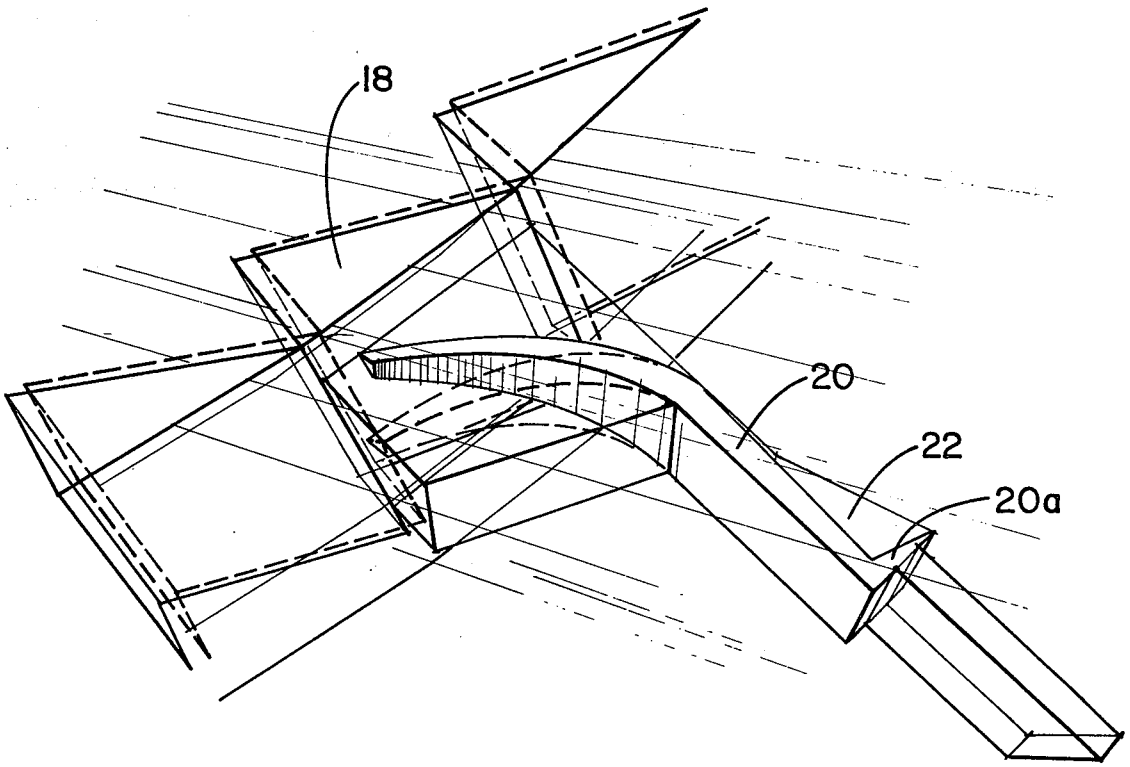
FIG. 8 is an enlarged perspective view of the ratchet assembly for the upper ratchet tooth minute dial of the conversion means.

As is shown more clearly in FIG. 8, ratchets 20,21 are held firmly in place in housing 22,23 by means of flanges 20*a*,21*a*. These flanges on being inserted into their respective housings are folded against the ratchet; however, once inside the housing the flanges expand and provide pressure against the housing surface.

Figure 5:
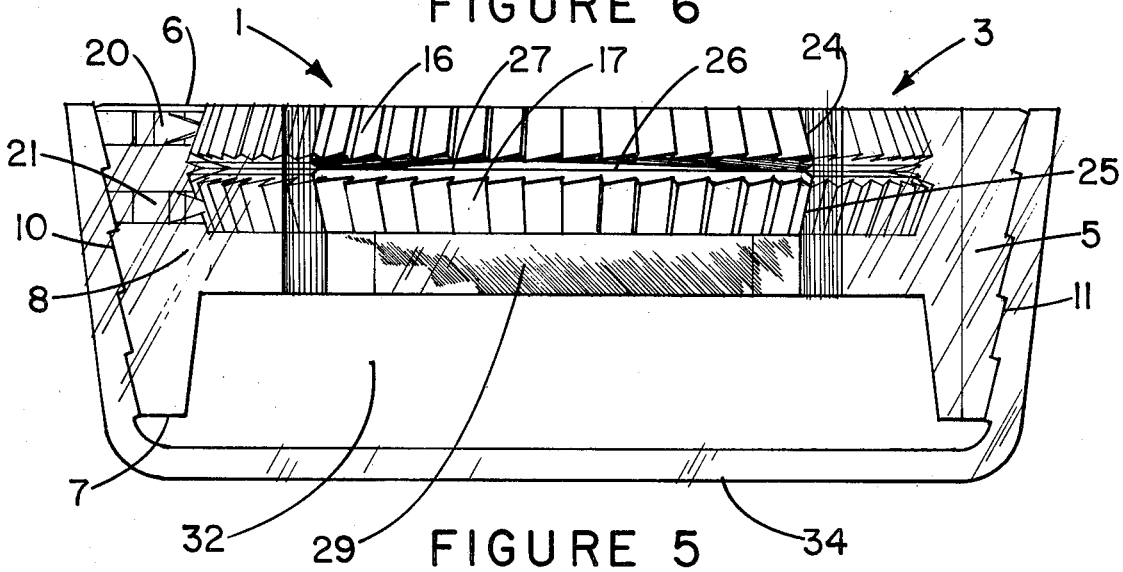
FIG. 5 is a side view of the conversion means of the invention without the parent watch.
Figure 7:
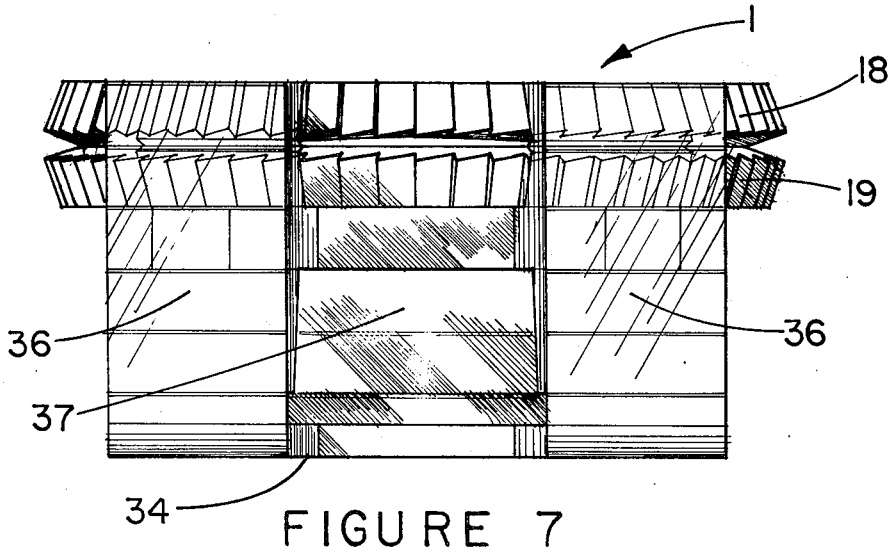
FIG. 7 is an end view of the conversion means taken looking at the right end of the conversion means as shown in FIG. 5.

Housing 5 is provided with reverse bevels, as indicated by reference numerals 24,25, to receive and hold in place dials 16,17. Bevels 24,25 are of a complementary configuration to the beveled circumferential ratcheted surfaces 18,19 of dials 16, 17 as shown more clearly in FIGS. 4,5 of the drawing. The dials can be readily assembled with housing 5 by flexing the dials to a degree to be received in the housing.

As will be appreciated, the tolerances between the housing and dials are such as to permit the dials to be positioned and provide a rather tight fit, but still allow relatively easy movement of the dials by finger movement, as and when desired. Ratchet teeth 18,19 can be, as will be appreciated, beveled at various angles as desired, so long as the bevels for each dial are of equal, but opposite angles. A suitable bevel for dial 16 is about 70 degrees and for dial 17 is about (−) 70 degrees. It is essential that the spacing of the ratchet teeth around the circumference of dials 16, 17 be equal, e.g., each tooth is spaced six degrees from a next adjacent tooth.

Figure 2:
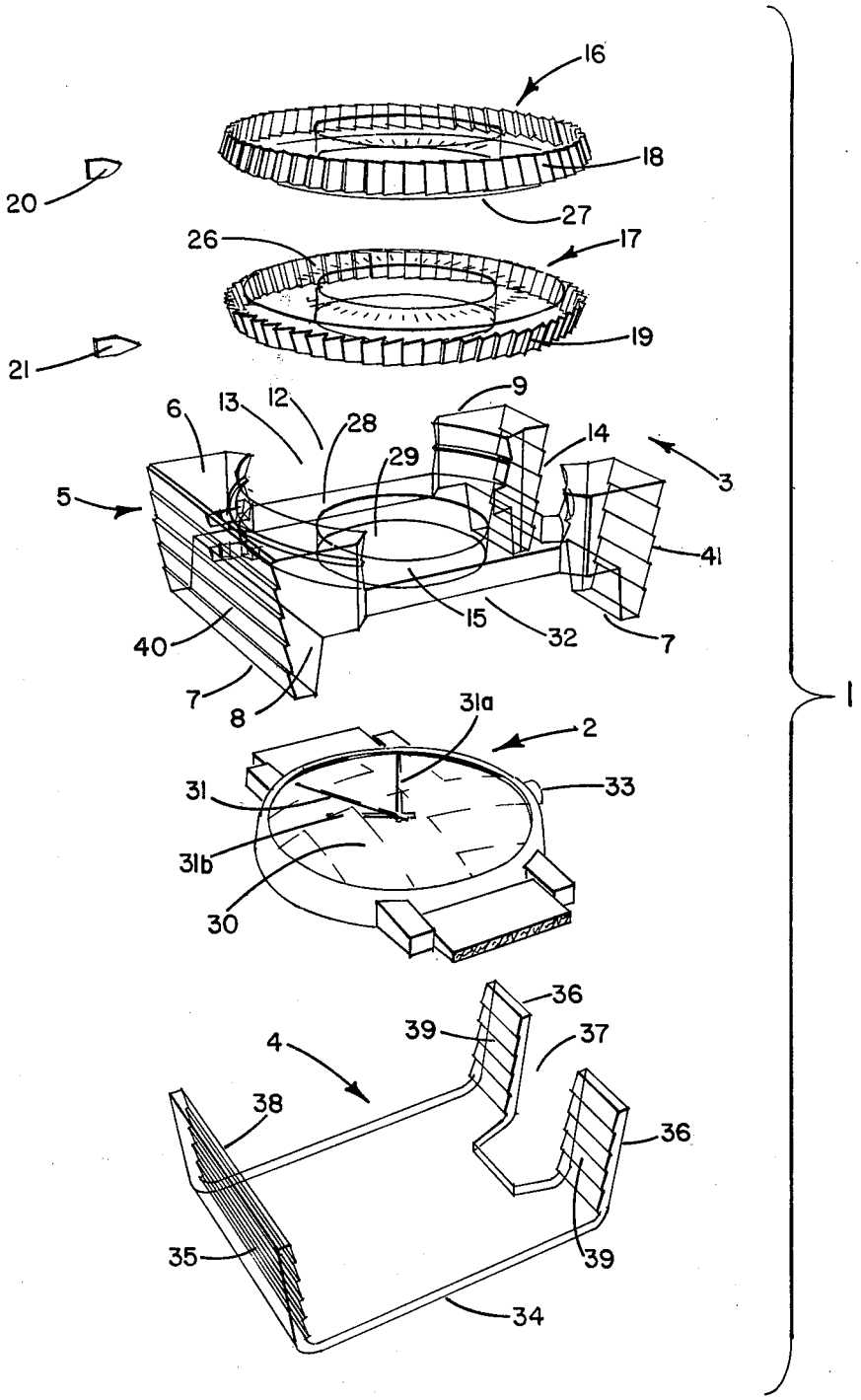
FIG. 2 is an exploded view of the combination shown in FIG. 1.

The top surface 26 of dial 17 is inscribed in some conventional manner with 60 one second marks, as is more clearly shown in FIG. 3 of the drawing. These marks as shown by the drawing are uniformly spaced about the annular surface and are provided in circular, counterclockwise fashion, indicating from 0 to 60 seconds. In a like manner the bottom surface 27 of dial 16 is inscribed with ten one minute marks, also as is shown in FIG. 3. The minute marks are of the same spacing as the second marks, and are seen to coincide with them. As the dials are manufactured and this is an intricate part of the invention, of a clear plastic material such as polyethylene, the inscribed minute and second marks are clearly visible. In the base surface 28 of recess 12 there is provided a circular shaped opening 29 for centering or cradling of housing 5 onto parent watch 2. As seen in FIG. 2, parent watch 2 has a dial 30, sweep second hand 31, an hour hand 31*a* and a minute hand 31*b*. Parent watch 2 is located in a recess 32 in housing 5 when face piece assembly 3 and back assembly 4 are joined together. When the face piece assembly 3 and back piece 4 are joined together, as hereinafter described, stem wind 33 of parent watch 2 is located for access in outlet 14 of housing 5.

Back assembly 4 is somewhat flexible and of one piece construction and comprises a base 34 from which ends 35,36 depend upwardly at a ninety degree angle. Desirably, however, ends 35,36 are capable of being flexed outwardly from base 32 and from the vertical at an angle of about 8–10 degrees for a reason hereinafter made obvious.

A stem wind cutout 37 is provided in end 36 which corresponds in location and dimension to cut out 14 in housing 5 whereby access is provided for stem wind 33 when face piece assembly 3 and back assembly 4 are assembled together in combination with parent watch 2.

The inside surfaces of ends 35, 36 are provided with a plurality of gripping means 38,39 respectively, which in the practice of the invention are ship lap as shown in FIG. 2. However, as will be appreciated hereinafter, other fastening or gripping means can be provided instead of desired.

On ends 10, 11 of housing 5 are provided ship lap 40,41 or other gripping means which extend laterally from one side to the other of housing 5. These gripping means, i.e., ship lap 40,41 correspond to and match with ship lap 38, 39 and provide secure but temporary interlocking engagement between face piece assembly 3 and back assembly 4.

To assemble face piece assembly 3 to back assembly 4, the racing skipper, or another, first places back assembly 4 into position with the back of the parent watch. This is done desirably before boarding the boat and can be accomplished with the watch loosely strapped on one's wrist. Next, face piece assembly 3 is set in position between ends 35,36 of back assembly 4 with ends 10,11 of housing 5 in contact with ends 35, 36 respectively of back assembly 4. Pushing the facepiece assembly 3 toward the watch and toward back assembly 4 then locks the gripping or ship lap surfaces together while at the same time centering the housing on the watch face. In the practice of the invention it is desirable that pads 42,43 of soft cushion material such as polyurethane foam or the like be provided in recess 32, as shown, in FIG. 4 of the drawing. However, this is optional and pads need not be always provided. These pads serve to provide housing 5 and parent watch 2 in relatively fixed engagement with one another. Pads 42,43 can be either provided adhesively secured to housing 5 or loose, as desired. The pads are desirably provided of somewhat oversize and can be trimmed with a razor or other sharp instrument to better conform to or fit parent watch 2.

When so interlocked together with a parent watch as described, the combination is then ready for use as a yachting timer, i.e., as a countdown means to determine the time remaining before the start of a race. In use, at the 30 second drop of either the warning or preparatory shape, the minute dial is rotated in its free direction until either the 10 minute mark for the warning signal or the 5 minute mark for the preparatory signal is set accordingly. This setting should be made so as to lead the parent watch minute hand one half minute or less.

When either signal, i.e. the warning or preparatory, is then actually given, e.g. the shape is raised or gun sounded, the location of the wrist watch sweep second hand is marked, i.e., noted by eye, and the 60 second dial is then rotated in its free direction until the 60 second mark on the dial coincides with the second mark previously noted on the parent watch. The countdowner of the invention is then in operation and will provide the skipper with time-to-go to the start of the race.

The racing skipper wearing the countdowner of this invention will notice in its use, and when set as above described, the parent watch minute hand will reach the 10 or 5 minute mark of the minute dial, depending on which signal the settings are based on, at the moment the particular signal is given and that the wrist watch minute hand and sweep second hand will be moving into the 9th or 4th minute, accordingly, and generally into the fifties of the seconds in the overall countdown.

It will be observed that the countdown provided by the yacht timer according to the invention is similar to that provided with yacht timers now available, but with possibly one small difference. The zero second mark and the zero minute mark may not exactly coincide with the time on the parent watch at the signal to start. The difference depends on the lapsed time taken by each racing skipper in setting the dials at the time the warning or preparatory signal is given. However, with use, a racing skipper should be able to better judge how the dials are best set.

Between races or when otherwise not being used, face piece assembly 3 can be loosened from back assembly 4 and secured in a jacket pocket or the like. The face piece can be released form the back assembly in any of several ways, which will disengage the interlocking ship lap from one another. One way is to press down on one end of the back assembly e.g., end 36 with one's thumb. However, as the interlocking means will not disengage accidentally, it may be necessary to use some considerable force to cause disengagement. Another means to disengage the interlocking means is by inserting an elongated member such as a knife blade or tooth pick into the stem wind outlet and flexing the end of the back assembly.

Housing 5, dials 16, 17, ratchets 20,21 and back assembly 4 can all readily be molded e.g., by injection molding, from various plastic materials, e.g. polyethylene, polypropylene, polyvinyl chloride and the like. As the scribed marks on the dials and the face of the watch must be visible, the plastic composition for all components except the back assembly 4 and ratchets 20,21 must be of a clear composition. Although the components can be most readily manufactured by molding, it is believed obvious that the various components can also be machined from solid stock, if desired.

As will be appreciated, face piece assembly 3 and back assembly 4 can be, if desired, made of various dimensions to fit various particular styles and sizes of wrist watches. However. for most watches one size can be manufactured of somewhat oversize dimension. The conversion means of the invention can then be trimmed to a somewhat better fit by means of a razor or other sharp cutting instrument.

While the invention has been more particularly described with respect to a means for converting a parent wrist watch to a yacht timer, it is obviously not so limited. The dial means housing can be modified so as to fit on to a sweep second pocket watch, if desired. Moreover, rather than providing a back assembly, as disclosed, the housing can be modified in suitable fashion at its base to provide a more or less permanent combination with a parent wrist or pocket watch. In connection with such a modification, the polyurethane foam pads referred to earlier can be used as a mounting means with suitable adhesive to provide the housing in combination with a parent watch, or a clear adhesive such as an epoxy can be used to secure the housing to the watch.

It will also be appreciated that a conversion means such as disclosed herein can be provided with various modified housing that makes it an integral part of a sweep second wrist watch. As such a yacht timer does not require the intricate mechanism of a conventional yacht timer, it can be provided much more economically.

As many different embodiments of this invention will now occur to those skilled in the art, it is to be understood that the specific embodiment of the invention as presented herein is intended by way of illustration only and not limiting on the invention, but that the limitations thereon shall be determined only from the appended claims.

What I claim is:

1. Means for converting a conventional sweep second watch into a countdown timer for use in yacht racing comprising a face piece assembly for association with the face piece of said watch, and a back assembly for association with the back of the watch and for temporary interlocking engagement with said face piece assembly, said face piece assembly comprising superposed first and second annular components of a clear plastic material each of the same predetermined inner and outer radii, each said annular component having top and bottom planar surfaces parallel to one another and an outer circumferential beveled surface, the bottom one of said superimposed annular components being inscribed on its top annular surface in circular, counterclockwise fashion in predetermined location with sixty one second marks uniformly spaced and indicating from 0 to 60 seconds, and the top superimposed annular component being inscribed on its bottom surface in circular, counterclockwise fashion in predetermined location with ten one minute marks each mark being spaced the same as the one second marks and indicating from 0 to 10 minutes, the beveled circumferential surface in the bottom annular component being of an equal but negative angle to that of the beveled surface in the top annular component, ratchet teeth being provided and uniformly spaced in each beveled, circumferential surface, the ratchet teeth in one surface being of opposite direction to those in the other surface, a housing for said annular components defined by a top planar surface and a bottom planar surface parallel to the said top surface, said members, and end members, a recess in said top planar surface of the housing of generally circular configuration for receiving and supporting the said annular components and in which the annular components are mounted in superposed parallel relation to one another and in such a manner as to be substantially parallel to said top planar surface, reverse beveled surfaces being provided in the circumferential surface of the said recess for association with the beveled ratchet teeth on the superposed annular components, means provided in each reverse beveled surface for association with said respective ratchet teeth permitting movement of each annular component in only one direction, a recess in the bottom surface of the housing for location of the said sweep second watch, a circular shaped opening in the base of the circular shaped recess in the top surface concentric with the said circular shaped recess and extending into the recess in the bottom surface, said circular shaped opening providing with the recess in the bottom a means for cradling the housing onto the said watch, an opening in one said end of the housing for access to the stem wind of the sweep second watch, said annular components being of such an outer diameter as to provide a portion thereof non coextensive with the sides of the housing and extending beyond the housing sides whereby said annular components can be independently turned by hand as desired.

2. Means for converting a conventional sweep second watch into a countdown timer for use in yacht racing according to claim 1 wherein the side members of the housing are planar and parallel to one another and the beveled circumferential surfaces of the annular components extend beyond these side members.

3. Means for converting a conventional sweep second watch into a countdown time for use in yacht racing according to claim 1 wherein the back assembly is flexible and comprises a base having turned up ends depending upwardly therefrom at 90 degree angles and said housing is capable of being positioned between the turned up ends for detachable connection.

4. Means according to claim 3 wherein means are provided on the turned up ends and the ends of the housing for detachable interlocking engagement.

5. Means according to claim 4 wherein said interlocking means comprise ship lap.

6. Means for converting a conventional sweep second watch into a countdown time for use in yacht racing according to claim 1 wherein resilient cushion means are provided in the said recess for providing stationary engagement of the housing with the parent watch.

7. Means for converting a sweep second timepiece to a countdown timer for use in sail boat racing starts comprising first and second superimposed, coextensive, annular components of predetermined inner and outer radii of a clear, plastic material, each said annular component having a top annular surface and a bottom annular surface, and an outer circumferential surface, said annular surfaces in each said annular component being planar and parallel with respect to one another, one of said annular components being inscribed uniformly on one of its planar annular surfaces in circular, counterclockwise fashion in predetermined location with one minute marks indicating from 0 to 10, and the other annular component being inscribed in circular, counterclockwise fashion in predetermined location on one of its planar annular surfaces with sixty one second marks indicating 0 to 60, said marks being of equal spacing and coinciding with the minute marks, beveled ratchet teeth uniformly spaced on the outer circumferential surfaces of the annular components, said ratchet teeth on one of said annular components being provided in opposite direction to those on the other, and the ratchet teeth on one of said components being beveled at one angle and on the other component at an equal but negative angle, a housing for receiving and supporting the said annular components, in superposed and rotatable fashion, and means in said housing in association with the said ratchet teeth to permit the first annular component to independently rotate in one direction only and the second annular component only in the opposite direction.

* * * * *